United States Patent [19]

Lee

[11] Patent Number: 5,069,057

[45] Date of Patent: Dec. 3, 1991

[54] PUNCH PRESS WITH INDEPENDENTLY OPERATED PRESSING UNITS DRIVEN BY A CRANKSHAFT

[75] Inventor: Yuan-Ho Lee, Tainan Hsieng, Taiwan

[73] Assignee: San Shing Hardware Works Co., Ltd., Tainan Hsieng, Taiwan

[21] Appl. No.: 459,312

[22] Filed: Dec. 29, 1998

[51] Int. Cl.[5] ..... B21D 43/10

[52] U.S. Cl. ..... 72/405; 72/404; 72/422; 72/456; 72/452; 10/12 T; 10/76 T; 100/282

[58] Field of Search ..... 72/404, 405, 456, 472, 72/422, 356, 452; 10/11 T, 12 T, 76 T; 100/282, 285

[56] References Cited

U.S. PATENT DOCUMENTS

| | | | |
|---|---|---|---|
| 3,022,526 | 2/1962 | Davis et al. | 10/76 T |
| 3,069,917 | 12/1962 | Hilgers | 10/12 T |
| 3,120,770 | 2/1964 | Hoyt | 10/12 T |
| 3,452,693 | 7/1969 | Azzariti | 72/405 |
| 3,596,498 | 8/1971 | Bradlee | 72/405 |
| 3,695,088 | 10/1972 | Alvi et al. | 72/405 |
| 3,717,890 | 2/1973 | Weller | 10/12 T |
| 3,785,194 | 1/1974 | Bradlee | 72/405 |
| 3,863,486 | 2/1975 | Lassy | 72/405 |
| 4,003,237 | 1/1977 | O'Keefe | 72/405 |
| 4,255,955 | 3/1981 | Lee | 10/76 T |

*Primary Examiner*—David Jones

*Attorney, Agent, or Firm*—Oblon, Spivak, McClelland, Maier & Neustadt

[57] ABSTRACT

A punch press includes a driving crankshaft and a plurality of independent punch pressing units. The crankshaft has a plurality of angularly spaced eccentric sections. Each of the punch pressing units includes a slide, a coupler interconnecting the slide and one of the eccentric sections of the crankshaft, a punch carried on the slide, a die set, and a workpiece gripping unit.

10 Claims, 10 Drawing Sheets

PUNCH PRESS WITH INDEPENDENTLY OPERATED PRESSING UNITS DRIVEN BY A CRANKSHAFT

BACKGROUND OF THE INVENTION

This invention relates to a punch press, more particularly to a punch press including a plurality of punch pressing units which have a common driving crankshaft with several angularly spaced eccentric sections.

In this art, a punch press includes several punch pressing units, each of which consists of a punch and a die set. Referring to FIG. 1, an earlier conventional punch press includes a frame A1, a crankshaft A2, a coupler A3 connected to the eccentric portion of the crankshaft A2, a ram A4 with several punches A5, and several die sets A6. The punches A5 effect different forging operations. Because of the difficulty in registering the center of gravity of the ram A4 with the coupler A3 and the rather large pressure created by the ram A4, stress concentration and unbalance take place on the ram A4, resulting in deformity and wear of said ram A4. Consequently, the precision and lifetime of the punch press are reduced.

Referring to FIG. 2, to minimize the unbalance of the punch press shown in FIG. 1, two aligned couplers B5 connect a ram B1 to the eccentric portion of a crankshaft B4. However, the unbalance condition will still occur in the punch press due to the fact that punches B2 effect different forging operations and apply pressures of different magnitudes to dies B3.

Several workpiece gripping units are provided on the punch presses shown in FIGS. 1, 2 so as to move workpieces between the dies A6, B3. When one of the gripping units malfunctions, although the malfunctioned gripping unit can be immediately stopped, there is still a high degree of unbalance during the punch pressing process. This unbalance damages the parts of the punch press. Furthermore, because all of the punches A5, B2 effect the forging operation at the same time, it is necessary to output a very large amount of power to the ram A4, B1. As a result, the lifetime of the crankshaft A2, B4 is reduced.

Referring to FIG. 3, a conventional workpiece gripping unit includes a carrier (C) with an enlarged block C1 disposed at the lower end thereof. The block C1 has a lower end surface C2 with two aligned retaining grooves C3, C4, and two opposite side surfaces C5 with threaded holes C6. Two adjustment bolts C7 extend through the threaded holes C6 of the block C1 to press against two curved spring sheets E1, E2, which push two gripping arms D1, D2 against the partition C8 of the block C1. Each of the gripping arms D1, D2 has a gripping notch D11, D21 formed in the inward side surface thereof, and a retaining notch D12, D22 formed in the outward side surface thereof. The gripping notches D11, D21 of the gripping arms D1, D2 define an accommodating space in which a workpiece can be clamped tightly between the gripping arms D1, D2. The upper ends E11, E21 of the spring sheets E1, E2 are inserted into the retaining notches D12, D22 of the gripping arms D1, D2. This gripping unit suffers from the following disadvantages:

(1) The retaining grooves C3, C4 of the block C1 must be sufficiently large to accommodate both the upper end portions of the gripping arms D1, D2 and the spring sheets E1, E2. Accordingly, it is necessary to increase the volume of the gripping unit.

(2) Because the spring sheets E1, E2 are entirely accommodated in the retaining grooves C3, C4 of the block C1, the outward movement of the lower ends of the gripping arms D1, D2 is limited. Thus, the gripping arms D1, D2 cannot clamp a workpiece of large size therebetween.

(3) It is understood in the machining field that the formation of the retaining grooves C3, C4 in the block C1 is time-consuming. For example, the block C1 is first drilled to form circular grooves and is subsequently machined to form rectangular grooves.

SUMMARY OF THE INVENTION

An object of this invention is to provide a durable punch press which can increase the balance of its parts during the operating process.

Another object of this invention is to provide a punch press which requires a smaller operating space.

Still another object of this invention is to provide a punch press which can increase the outward displacement of the lower ends of the gripping arms.

According to this invention, a punch press includes a frame, a crankshaft, a plurality of punching units, a ram unit mounted slidably on said frame so as to carry said punching units, a coupler unit connecting said ram unit to said crankshaft, a bed, a plurality of dies disposed on said bed, and a workpiece gripping device adapted to carry and move workpieces between said dies. The crankshaft has a plurality of angularly spaced eccentric sections The coupler unit includes a plurality of couplers respectively and rotatably connected to the eccentric sections of the crankshaft. The ram unit includes a plurality of slides respectively and rotatably connected to the couplers so as to impel the punching units. The workpiece gripping device includes a plurality of separate gripping units respectively arranged in association with one of the punching units, so as to constitute a plurality of punch pressing units, one of which includes one of the eccentric sections of the crankshaft, one of the couplers, one of the slides, one of said punching units and one of said gripping units. Each adjacent pair of axes of the eccentric sections of the crankshaft are angularly spaced at an angle of less than 40 degrees.

Each of the gripping units includes a carrier movably mounted on the frame and having an open-ended slot formed in the lower end surface of the carrier, a connector secured to the lower end surface of said carrier and having two opposite side surfaces, each of which has an open-ended slot, two gripping arms respectively disposed within said slots of the connector, and a spring element secured in said slot of said carrier so as to retain said gripping arms on said connector. The spring element is generally inverted U-shaped and has two downward and inward extending end portions, between which the gripping arms are clamped tightly against the connector. The slots of the connector are aligned with the slot of the carrier so that said connector has a lower portion with a H-shaped cross-section. The spring element includes a bolt screwing said spring element into the slot of the carrier. The bolt has a head located at the lower end of the spring element. The connector has a recess formed in the upper end surface thereof within which the head of the bolt is engaged. Thereby, the connector can be easily positioned with respect to the carrier. The connector includes an upper end projection in which the recess is formed. The upper end projection of the connector is engaged in the slot of the carrier.

BRIEF DESCRIPTION OF THE DRAWING

Other features and advantages of this invention will become apparent in the following detailed description of a preferred embodiment of this invention, with reference to the accompanying drawings in which.

DETAILED DESCRIPTION OF THE PREFERRED EMBODIMENT

Figure 6:
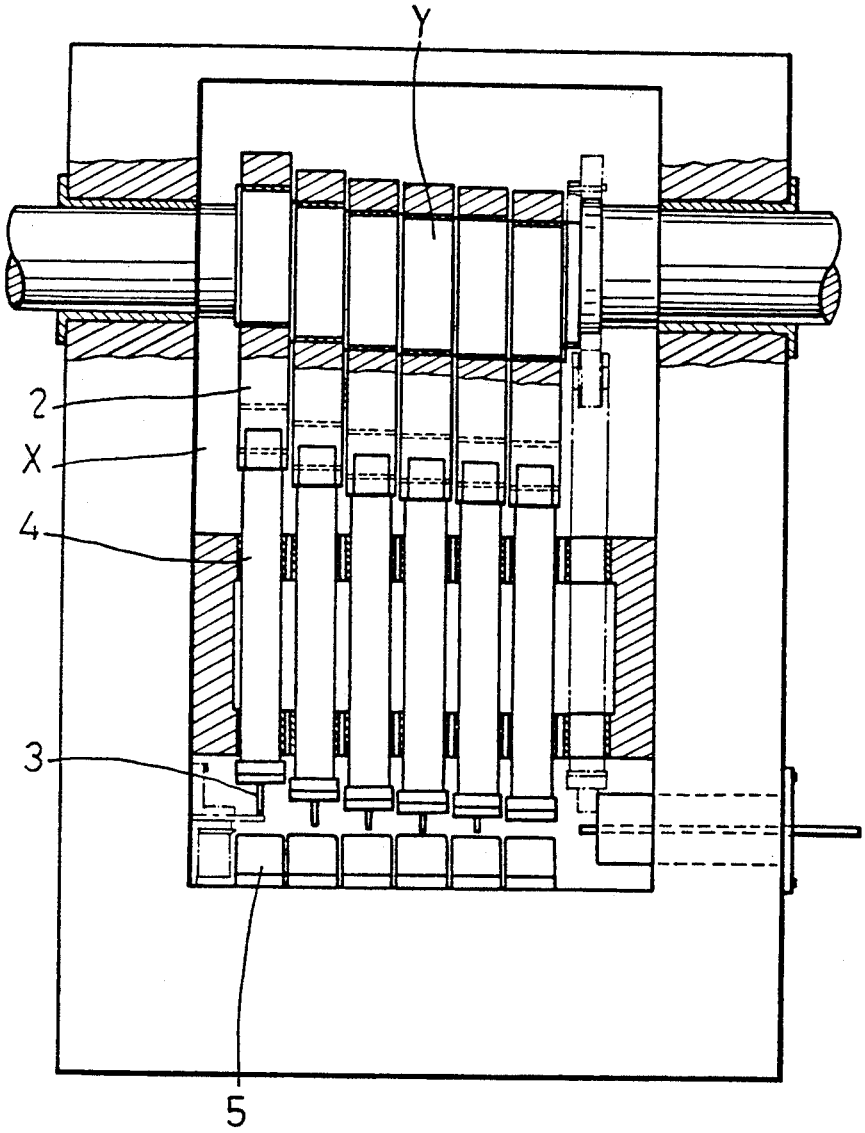
FIG. 6 is a schematic front view showing the operating portion of a punch press according to this invention.
Figure 8:
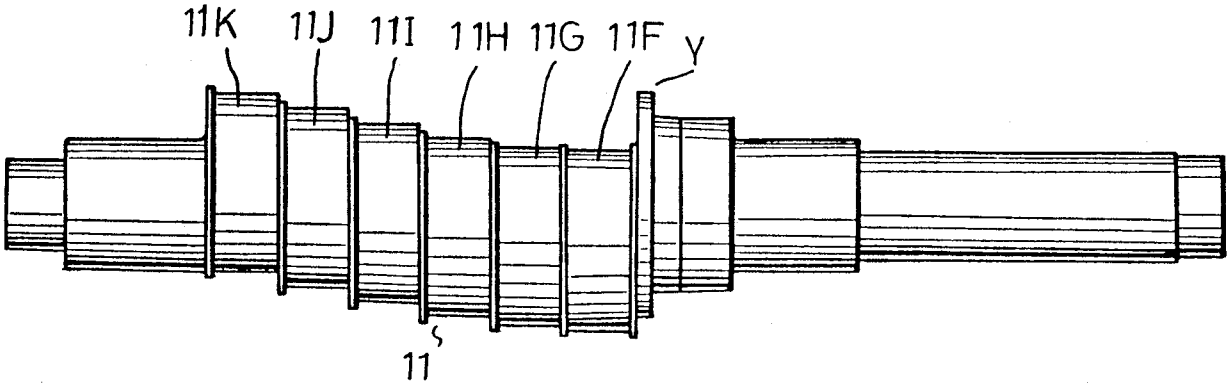
FIG. 8 is a schematic view showing the crankshaft of the punch press according to this invention.
Figure 9:
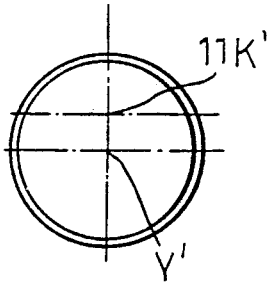
FIGS. 9–14 illustrate the eccentric angles of the eccentric sections of the crankshaft of the punch press according to this invention.
Figure 10:
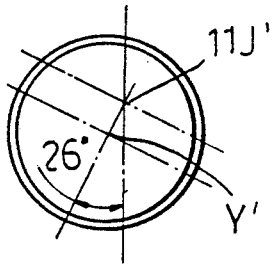
Figure 11:
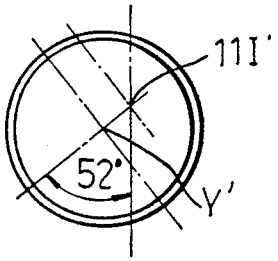
Figure 12:
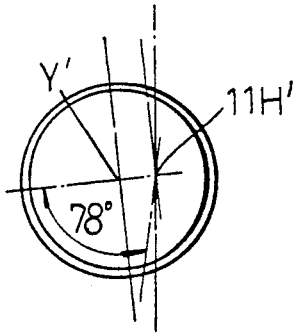
Figure 13:
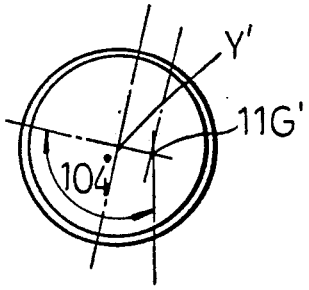
Figure 14:
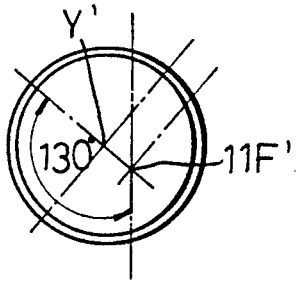

Referring to FIG. 6, a punch press of this invention includes six punch pressing units (X) and crankshaft (Y) for driving the punch pressing units (X). As shown in FIG. 8, the crankshaft (Y) has a driving portion 11. which has six angularly spaced eccentric sections 11F, 11G, 11H, 11I, 11J, 11K.

Figure 1:
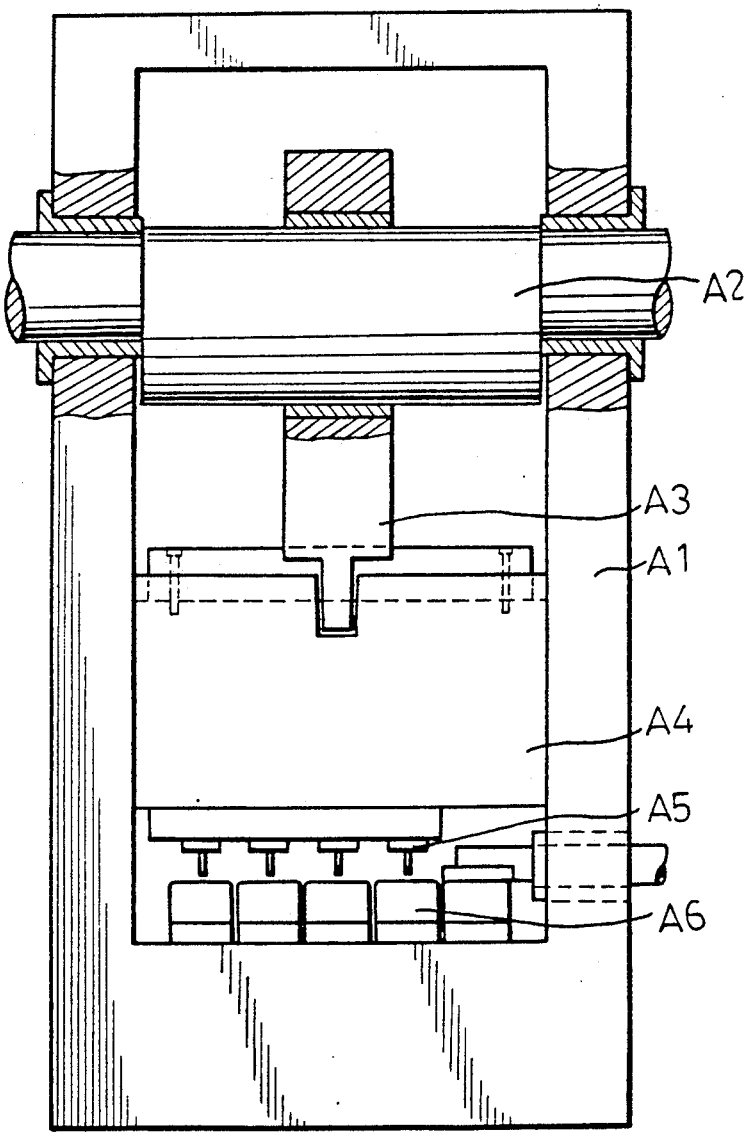
FIG. 1 (PRIOR ART)
FIG. 1 is a schematic view of a conventional punch press.
Figure 7:
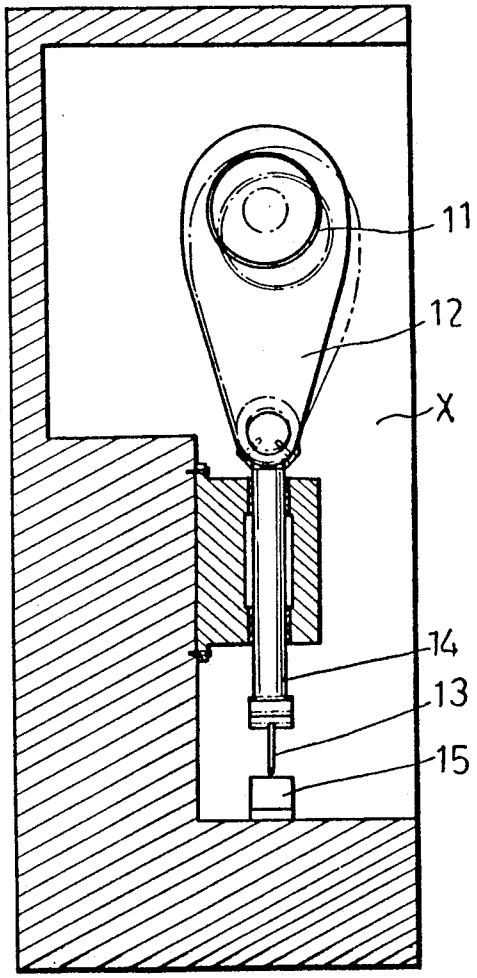
FIG. 7 is a schematic side view showing the operating portion of the punch press according to this invention.
Figure 2:
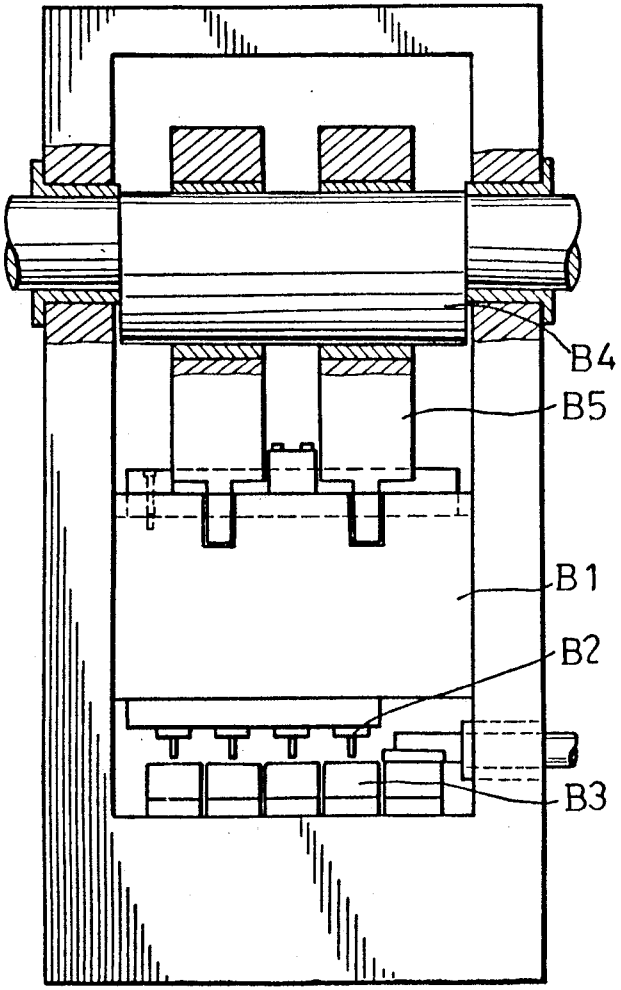
FIG. 2 (PRIOR ART)
FIG. 2 is a schematic view of another conventional punch press.
Figure 3:
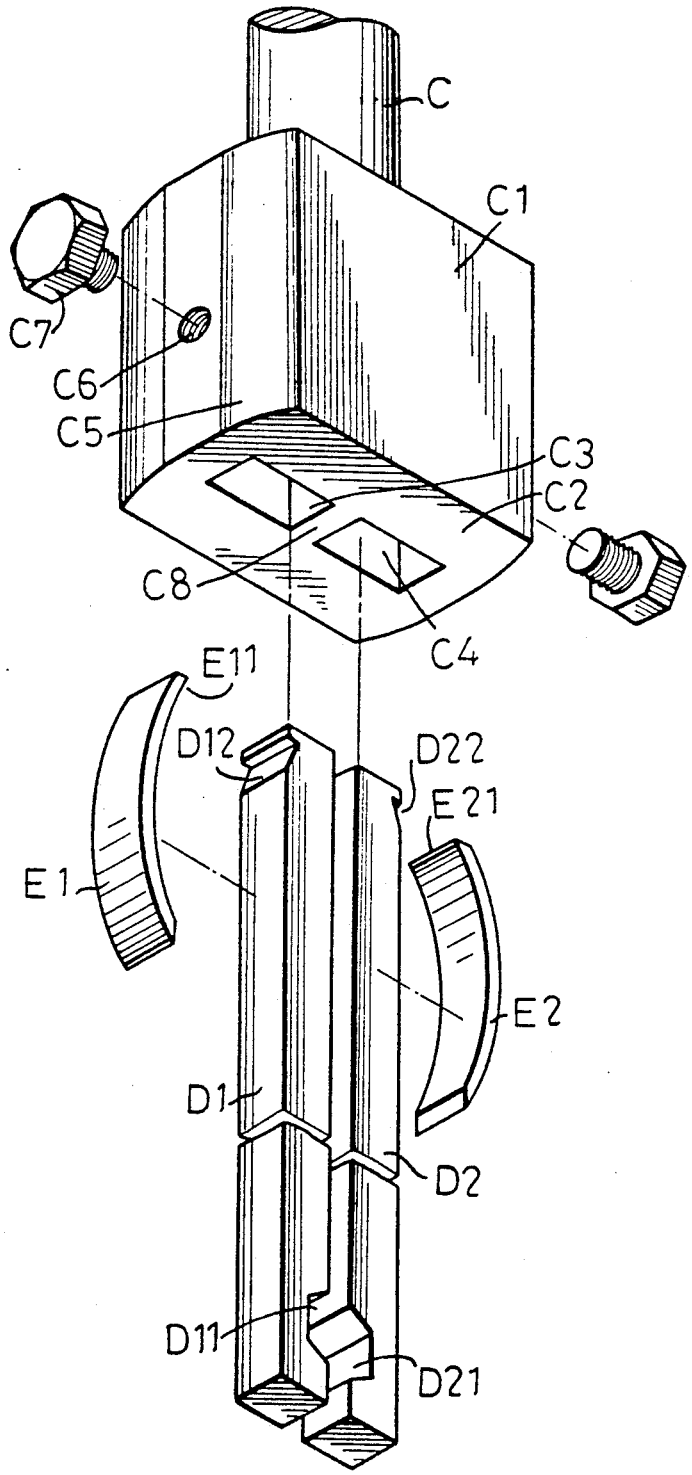
FIG. 3 (PRIOR ART)
FIG. 3 is an exploded view of a conventional workpiece gripping unit.
Figure 4:
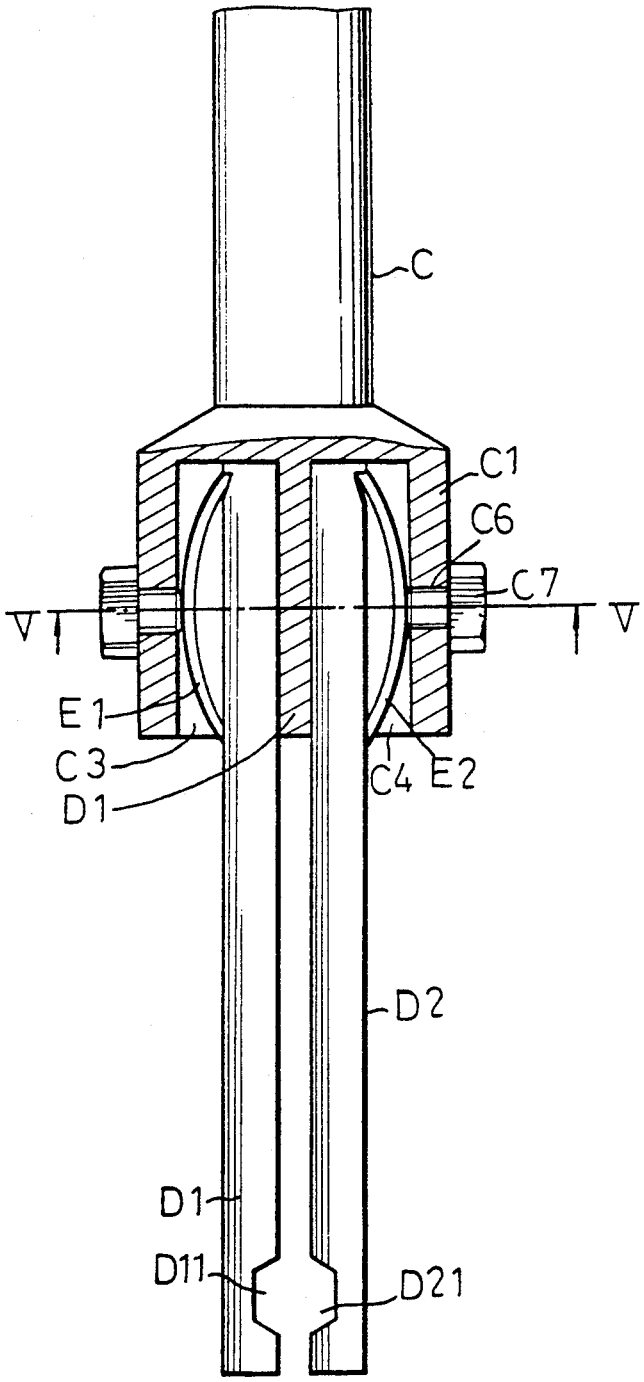
FIG. 4 (PRIOR ART)
FIG. 4 is an assembled sectional view of the conventional workpiece gripping unit.
Figure 5:
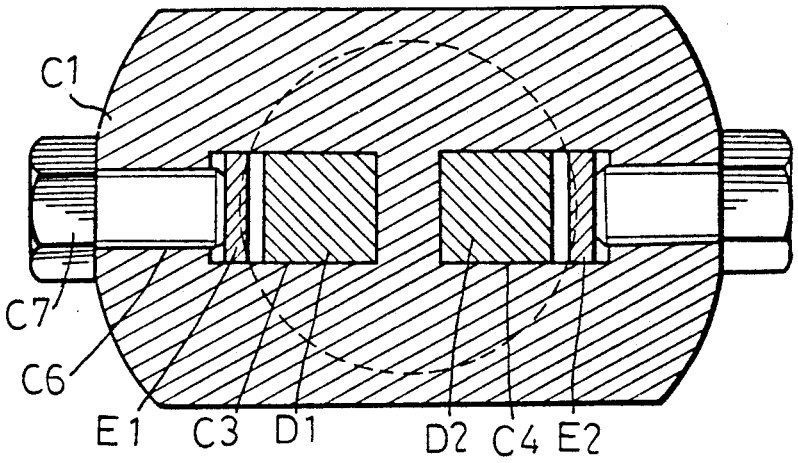
FIG. 5 (PRIOR ART)
FIG. 5 is a sectional view taken along Line V—V in FIG. 4.
Figure 17:
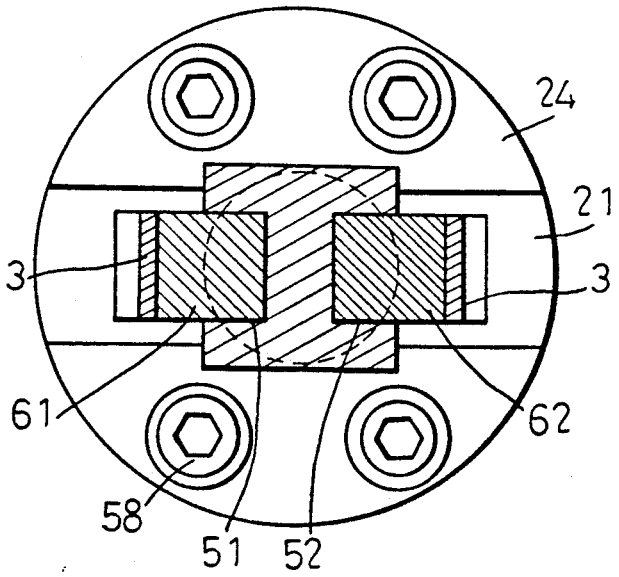
FIG. 17 is a sectional view taken along Line XVII—XVII in FIG. 16.

Referring to FIG. 7, each of the punch pressing units (X) includes a coupler 12 connecting a slide 14 to the driving portion 11 of the crankshaft (Y), a punch 13 carried on the slide 14, and a die 15 fixed on a bed. The punch pressing units (X) operate independently of each other. There is preferably less than a 40 degree difference between the eccentric angles of any adjacent pair of the eccentric sections 11F, 11G, 11H, 11I, 11J, 11K, each of which angles is formed between the line connecting the axis 11F', 11G', 11H', 11I', 11J', 11K' of the eccentric section to the rotating axis (Y') of the crankshaft (Y) and the vertical. As shown in FIGS. 9–14, in this embodiment, the eccentric angles of the eccentric sections 11F, 11G, 11H, 11I, 11J, 11K are 0, 26, 52, 78, 104, 130 degrees. In other words, the difference between the eccentric angles of any adjacent pair of eccentric sections 11F, 11G, 11H, 11I, 11J, 11K are 26 degrees. Accordingly, the crankshaft (Y) can drive only one of the six punch pressing units (X) a time. Because the power output of the crankshaft (Y) to any of the punch pressing units (X) is less than the power output of the crankshaft of the above-mentioned conventional punch presses shown in FIGS. 1, 2 to all of the punch pressing units (X), the lifetime of the crankshaft (Y) is increased. It is understood that the eccentric distances of the eccentric sections 11F, 11G, 11H, 11I, 11J, 11K are determined in accordance with the displacements of the respective slides 14 needed to punch press workpieces. Because each of the punch pressing units (X) effects an independent operation, the unbalance during the punch pressing process is diminished.

Figure 15:
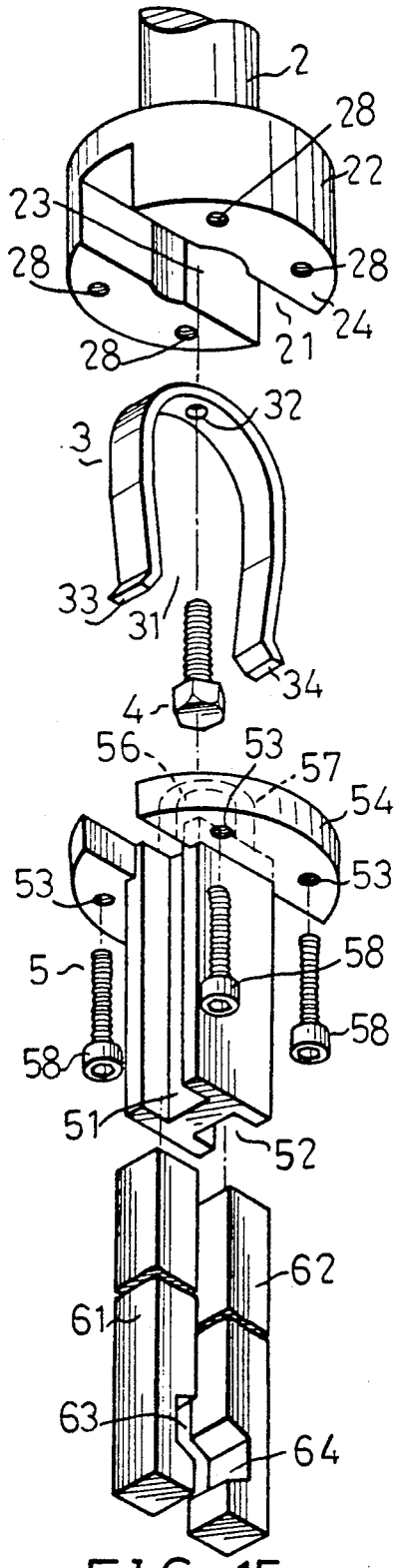
FIG. 15 is an exploded view showing the workpiece gripping unit of the punch press according to this invention.
Figure 16:
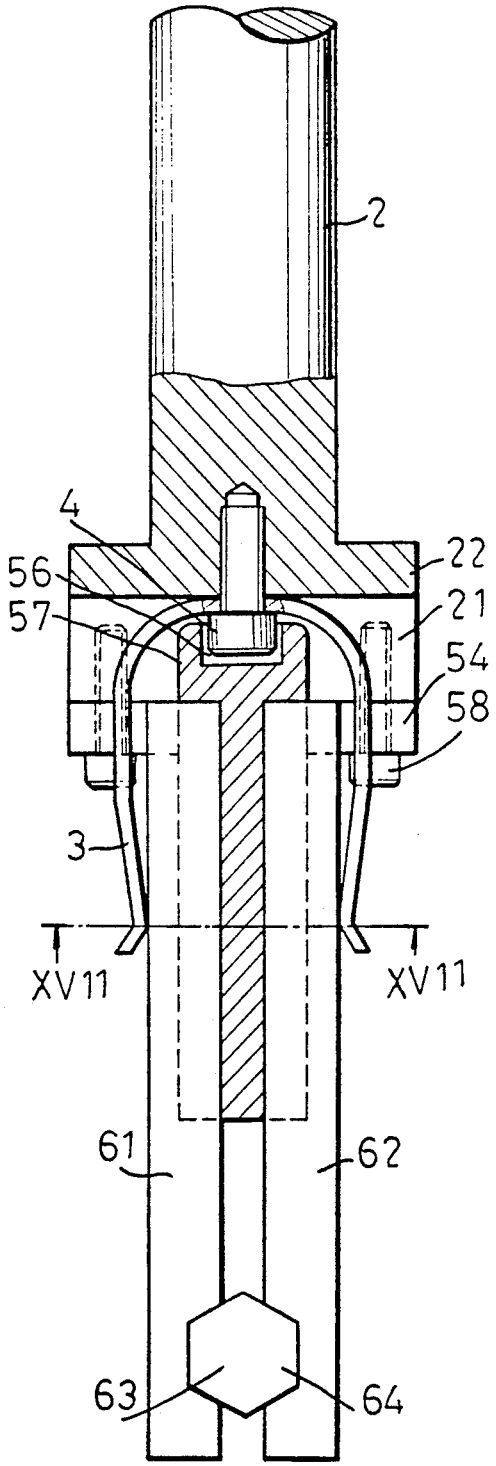
FIG. 16 is an assembled sectional view showing the workpiece gripping unit of the punch press according to this invention.

Each of the punch pressing units (X) is provided with a separate workpiece gripping unit. As shown in FIGS. 15, 16, the gripping unit includes a carrier 2, a generally inverted U-shaped spring element 3 with two downward and inward extending end portions 33, 34, a locking bolt 4, a connector 5 and a pair of gripping arms 61, 62 with gripping notches 63, 64.

The carrier 2 has a diameter-increased block 22 disposed at the lower end thereof. The locking bolt 4 extends through the hole 32 of the spring element 3 to engage threadably in the open-ended slot 21 in the lower end surface 24 of the block 22 of the carrier 2. Four bolts 58 are passed through the holes 53 in the upper end abutment plates 54 of the connector 5 to engage with the threaded holes 28 in the lower end surface 24 of the carrier 2, in such a manner that the circular upper end projection 57 of the connector 5 is engaged within the circular middle portion 23 of the slot 21 in the carrier 2. The upper end projection 57 of the connector 5 has a central recess 56 in which the head of the locking bolt 4 is engaged. The connector 5 has two open-ended slots 51, 52 formed in the vertical opposite side surfaces in alignment with the slot 21 of the carrier 2, so as to form a lower portion with a H-shaped cross-section. The gripping arms 61, 62 are placed into the slots 51, 52 of the connector 5 so as to form a workpiece accommodating space from the gripping notches 63, 64. Consequently, the gripping arms 61, 62 are clamped tightly within the gap 31 of the spring element 3.

The gripping unit has the advantages of reduced volume, ease of manufacture and assembly, and increased outward displacement of the end portions 33, 34 of the spring element 3.

The carrier 2 of the gripping unit is installed in the press bed so that the gripping notches 63, 64 of the gripping arms 61, 62 are positioned near the individual dies 15. The activation and operation of the gripping unit for moving the workpieces between various dies are similar to that of conventional punch presses.

With this invention thus explained, it is apparent that numerous modifications and variations can be made without departing from the scope and spirit thereof. It is therefore intended that this invention be limited only as indicated in the appended claims.

I claim:

1. A punch press includes a frame, a crankshaft, a plurality of punching units, a ram unit mounted slidably on said frame so as to carry said punching units, a couples unit connecting said ram unit to said crankshaft, a bed, a plurality of dies disposed on said bed, and a workpiece gripping device adapted to carry and move workpieces between said dies, wherein said crankshaft comprises a plurality of angularly spaced eccentric sections having different eccentric angles, said coupler unit including a plurality of couplers respectively and rotatably connected to said eccentric sections of said crankshaft, said ram unit including a plurality of slides respectively and rotatably connected to said couplers so as to impel said punching units, said workpiece gripping device including a plurality of separate gripping units respectively arranged in association with one of said punching units so as to constitute a plurality of punch pressing units, one of which includes one of said eccentric sections of said crankshaft, one of said couplers, one of said slides, one of said punching units and one of said gripping units, wherein said crankshaft having said eccentric sections at different eccentric angles drives only one punch pressing unit at a time such that each of said punch pressing units perform an independent operation.

2. A punch press as claimed in claim 1, wherein each adjacent pair of axes of said eccentric sections of said crankshaft are angularly spaced at an angle of less than 40 degrees.

3. A punch press as claimed in claim 2, wherein each adjacent pair of the axes of said eccentric sections of said crankshaft are angularly spaced at an angle of 26 degrees.

4. A punch press as claimed in claim 1, wherein each of said gripping units includes a carrier mounted movably on said frame and having an open-ended slot formed in a lower end surface of said carrier, a connector secured to said lower end surface of said carrier and having two opposite side surfaces, each of which has an open-ended slot, two gripping arms respectively disposed within said slots of said connector, and a spring element secured in said slot of said carrier so as to retain said gripping arms on said connector.

5. A punch press as claimed in claim 4, wherein said spring element is generally inverted U-shaped and has two downward and inward extending end portions between which said gripping arms are clamped tightly against said connector.

6. A punch press as claimed in claim 4, wherein said slots of said connector are aligned with said slot of said carrier so that said connector has a lower portion with a H-shaped cross-section.

7. A punch press as claimed in claim 4, wherein said spring element includes a bolt screwing said spring element into said slot of said carrier, said bolt having a head located at a lower end of said spring element, said connector having a recess formed in an upper end surface thereof within which said head of said bolt is engaged, whereby said connector can be easily positioned with respect to said carrier.

8. A punch press as claimed in claim 4, wherein said connector includes an upper end projection in which said recess is formed, said upper end projection of said connector being engaged in said slot of said carrier.

9. A punch press includes a frame, a crankshaft, a plurality of punching units, a ram unit mounted slidably on said frame so as to carry said punching units, a coupler unit connecting said ram unit to said crankshaft, a bed, a plurality of dies disposed on said bed, and a workpiece gripping device adapted to carry and move workpieces between said dies, wherein said crankshaft comprises a plurality of angularly spaced eccentric sections, said coupler unit including a plurality of couplers respectively and rotatably connected to said eccentric sections of said crankshaft, said ram unit including a plurality of slides respectively and rotatably connected to said couplers so as to impel said punching units, said workpiece gripping device including a plurality of separate gripping units respectively arranged in association with one of said punching units so as to constitute a plurality of punch pressing units, one of which includes one of said eccentric sections of said crankshaft, one of said couplers, one of said slides, one of said punching units and one of said gripping units;

wherein each of said gripping units includes a carrier mounted movably on said frame and having an open-ended slot formed in a lower end surface of said carrier, a connector secured to said lower end surface of said carrier and having two opposite side surfaces, each of which has an open-ended slot, two gripping arms respectively disposed within said slots of said connector, and a spring element secured in said slot of said carrier so as to retain said gripping arms on said connector;

wherein said spring element includes a bolt screwing said spring element into said slot of said carrier, said bolt having a head located at a lower end of said spring element, said connector having a recess formed in an upper end surface thereof within which said head of said bolt is engaged, whereby said connector can be easily positioned with respect to said carrier.

10. A punch press includes a frame, a crankshaft, a plurality of punching units, a ram unit mounted slidably on said frame so as to carry said punching units, a coupler unit connecting said ram unit to said crankshaft, a bed, a plurality of dies disposed on said bed, and a workpiece gripping device adapted to carry and move workpieces between said dies, wherein said crankshaft comprises a plurality of angularly spaced eccentric sections, said coupler unit including a plurality of couplers respectively and rotatably connected to said eccentric sections of said crankshaft, said ram unit including a plurality of slides respectively and rotatably connected to said couplers so as to impel said punching units, said workpiece gripping device including a plurality of separate gripping units respectively arranged in association with one of said punching units so as to constitute a plurality of punch pressing units, one of which includes one of said eccentric sections of said crankshaft, one of said couplers, one of said slides, one of said punching units and one of said gripping units;

wherein each of said gripping units includes a carrier mounted movably on said frame and having an open-ended slot formed in a lower end surface of said carrier, a connector secured to said lower end surface of said carrier and having two opposite side surfaces, each of which has an open-ended slot, two gripping arms respectively disposed within said slots of said connector, and a spring element secured in said slot of said carrier so as to retain said gripping arms on said connector;

wherein said connector includes an upper end projection in which said recess is formed, said upper end projection of said connector being engaged in said slot of said carrier.

* * * * *